United States Patent [19]

Potter

[11] 4,280,168

[45] Jul. 21, 1981

[54] FLASHLIGHT AND SIGNALLING APPARATUS

[76] Inventor: Bronson Potter, R.F.D. #1, Mason, N.H. 03048

[21] Appl. No.: 87,023

[22] Filed: Oct. 22, 1979

[51] Int. Cl.[3] ..... F21V 21/30

[52] U.S. Cl. ..... 362/35; 362/109; 362/159

[58] Field of Search ..... 362/159, 109, 35

[56] References Cited

U.S. PATENT DOCUMENTS 4,186,426 1/1980 Gingras et al. ..... 362/159

*Primary Examiner*—Stephen J. Lechert, Jr.

[57] ABSTRACT

An emergency flashlight for illumination or signalling comprising an abrasive member and a pyrophoric member. The abrasive and pyrophoric members are mounted for predetermined relative movement against each other to produce and project a stream of self-igniting particles of pyrophoric material abraded from the pyrophoric member. The position of the members and the direction of their relative movement is aligned to present the stream of particles to a light-transmitting combustion zone. As a flashlight, the device includes a reflector having a reflection or focal zone coincident with this combustion zone and constructed to beam the emitted light to the region to be illuminated. The reflector shields the eyes of the operator from the emitted light and from burning particles and, in preferred embodiments, is a uniform surface of revolution to provide a concentrated light beam. The reflector and abrasive and pyrophoric members can be protected by a transparent cover with the enclosed space vented to allow escape of combustion products and admission of oxygen. The pyrophoric member is preferably a rod adapted to be fed along its axis, as it is consumed, by a spring member, to engage the file-toothed rim of a rotating wheel that serves as the abrasive member. In the embodiments shown, the wheel is driven by a hand crank, an air motor and a battery-powered electric motor.

18 Claims, 5 Drawing Figures

FLASHLIGHT AND SIGNALLING APPARATUS

BACKGROUND OF THE INVENTION

This invention relates to an emergency flashlight or signalling device which has a substantially unlimited storage life, and is useful in camper, auto, aircraft and lifeboat emergency kits or as a diver's non-electrical light.

There is a general requirement for a lamp or flashlight for use in emergency situations, e.g., as a distress lamp for use on boats. Previously available light devices, such as flares and phosphorescent chemical lights are subject to chemical deterioration, which limits their storage life. Once turned on, such devices generally cannot be turned off when no longer needed, which limits their useful life and limits their use as signalling devices, e.g., for Morse code. Additionally, those flares which provide great amounts of light, are also dangerous to the user. Electrical lights are also subject to shelf life limitations, i.e., that of their batteries, and while they can be turned on and off, to conserve battery power and for signalling, require light bulbs with fragile filaments, are inefficient in the amount of light produced for the power consumed, and require heavy and bulky batteries that have short shelf life.

SUMMARY OF THE INVENTION

The invention described herein provides a lightweight, rugged, convenient flashlight or signalling device particularly suited for emergency use. The device has a virtually unlimited storage life, can be quickly turned off to extend its useful life and for signalling, and provides a high level of emitted light while being safe for the user.

The device comprises an abrasive member and a pyrophoric member mounted for predetermined relative movement against each other to produce and project a stream of self-igniting particles abraded from the pyrophoric member, which ignite upon exposure to the oxygen in the atmosphere. The direction of the relative movement is aligned to present the ignited particles to a light-transmitting combustion zone. As a flashlight, the apparatus includes a reflector having a reflection or focal zone coincident with the light-transmitting combustion zone and constructed to beam light to a region to be illuminated. In preferred embodiments, the reflector is a uniform surface of revolution, e.g., parabolic or conical, to provide a concentrated beam of light. The reflector and abrasive and pyrophoric members can be protected by a transparent cover and the enclosed space vented to allow the escape of combustion products and the admission of oxygen. The pyrophoric member is preferably a rod adapted to be fed along its axis, as it is consumed, by a spring member to engage the file-toothed rim of a rotating wheel comprising the abrasive member. The rod is preferably comprised of lanthanide-series misch steel or cerium iron, and the wheel of file steel. In an important embodiment, the wheel is manually driven by a hand crank, e.g., for use as an emergency lamp. In another important embodiment, the lamp is operated with the wheel driven by an air motor. The motor exhaust is vented into the enclosed space around the reflector to provide oxygen to the particles of pyrophoric material and is exhausted to carry off combustion products. In yet another embodiment, the wheel is driven by an electric motor operating off of batteries; this embodiment provides a much greater amount of light from the lamp than is available if the same amount of battery power were used to light any kind of electric light bulb.

DESCRIPTION OF THE INVENTION

Drawings

DESCRIPTION

Figure 1:
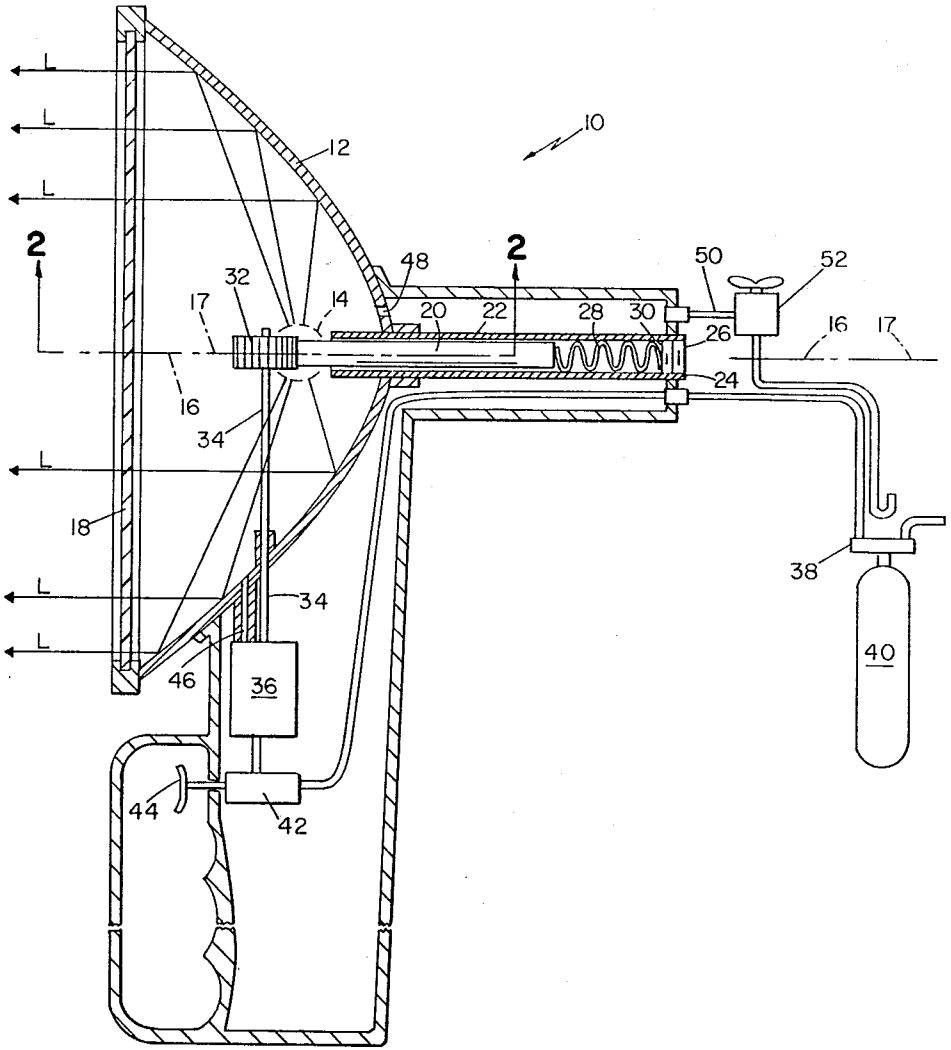
FIG. 1 is a sectional view of an air driven lamp embodying the invention.

Referring to FIG. 1, lamp 10 has a generally parabolic reflector-shield 12 of 5 inches diameter with reflection zone 14 located along axis 16. The opening at the front of the reflector is sealed to prevent the entry of surf and rain by transparent, pressure resistant window 18.

Sparking element 20 is a 3/16 inch diameter rod of pyrophoric metal, approximately 2¼inches long. The rod is preferably of lanthanide misch steel (available from Ronson Co.) or cerium-iron, and extends along axis 17, being held in tube 22. End 24 of the tube is sealed by water-proof threaded plug 26. Spring 28 is located between the plug and end 30 of the sparking rod and is under compression to urge the rod forward along axis 16 to engage abrasive wheel 32. Wheel 32 is preferably made of file steel and is ½ inch in diameter and ¼ inch thick. The rim of wheel 32 preferably has 24 file cut teeth per inch, and is designed to provide the maximum sparking effect when rotated against rod 20 and to allow the teeth to be self cleaning, i.e., to allow particles of sparking rod material to be ejected as the wheel rotates.

Figure 2:
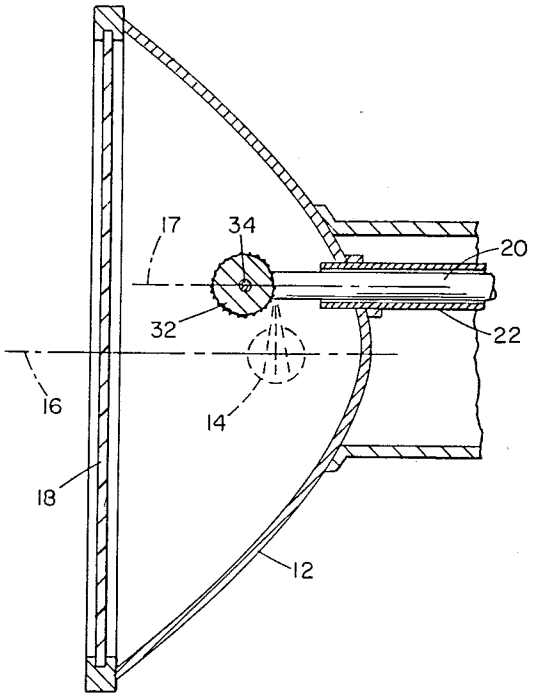
FIG. 2 is a view along 2—2 of FIG. 1.

As shown in FIG. 2, the wheel rotates in the clockwise direction against the sparking rod, abrading particles of pyrophoric material from the rod. The abraded particles are of dust-like size, to be self-igniting upon exposure to oxygen within the space enclosed by the reflector and window.

It is important, in achieving the maximum sparking effect, that the rod be stationary and the wheel move against the rod. The relative positions of the wheel and rod, i.e., along axis 17, are selected to lie on an axis generally passing through the reflection area so that the ignited particles are projected, due to the rotation of the wheel, while burning into the reflection zone of the reflector. The ignited particles thereby provide an intense source of light in the reflection zone and the light emitted by the particles is focused by the reflector, as indicated by lines L, into a uniform steady beam of light extending generally parallel along axis 16.

The reflector has a further important function in shielding the operator's eyes from the intense light generated by the sparking effect, in preserving the operator's visual adaption to low light level situations.

In the embodiment of FIG. 1, wheel 32 is driven through shaft 34 by air motor 36 at speeds of 5 rps. Motor 36 is provided with propelling gas from a bottle of pressurized gas 40, which can be a $CO_2$ cartridge or fire extinguisher or as shown from a scuba tank via a standard tap on first stage regulator 38 on the scuba tank. The flow of gas to motor 36, and thus the speed of the motor, is controlled by valve 42, which is in turn controlled by finger trigger 44. The exhaust gas from the motor, in the illustrated case of scuba air, passes through tube 46 into the space enclosed by reflector 12 and window 18, thereby providing a flow of oxygen to combine with the pyrophoric particles from the sparking rod. The gas exhausts from this enclosed space through opening 48, carrying with it the combustion products from the ignited particles and preventing a build-up of these products on the reflector and window. The exhaust gas leaves the lamp through piping 50 and flapper valve 52, which prevents the entry of water into the lamp from the exhaust, and is vented into the water behind the diver's head near regulator 38 to avoid obscuring the diver's vision with bubbles.

As indicated, the lamp assembly, including the sparking rod and tube, the motor control valve, the motor, and the exhaust gas escape path, are enclosed within a pressure resistant and water proof housing shaped to be conveniently held by the diver.

The intensity of the light emitted by the lamp is a function of the pressure by which rod 20 engages wheel 32 and the speed at which the wheel is rotated. Variable control valve 44, by controlling the speed of the wheel, allows control of the light emitted by the lamp and allows the operator to compensate for light variations due to variations in spring 28 or the pressure of the propelling gas to the motor. In an alternate embodiment, gas at a constant pressure, e.g., exhaust gas, is injected into the space shown as occupied by spring 28 and replaces the spring in forcing the rod against the wheel, but does so with a constant pressure.

Figure 3:
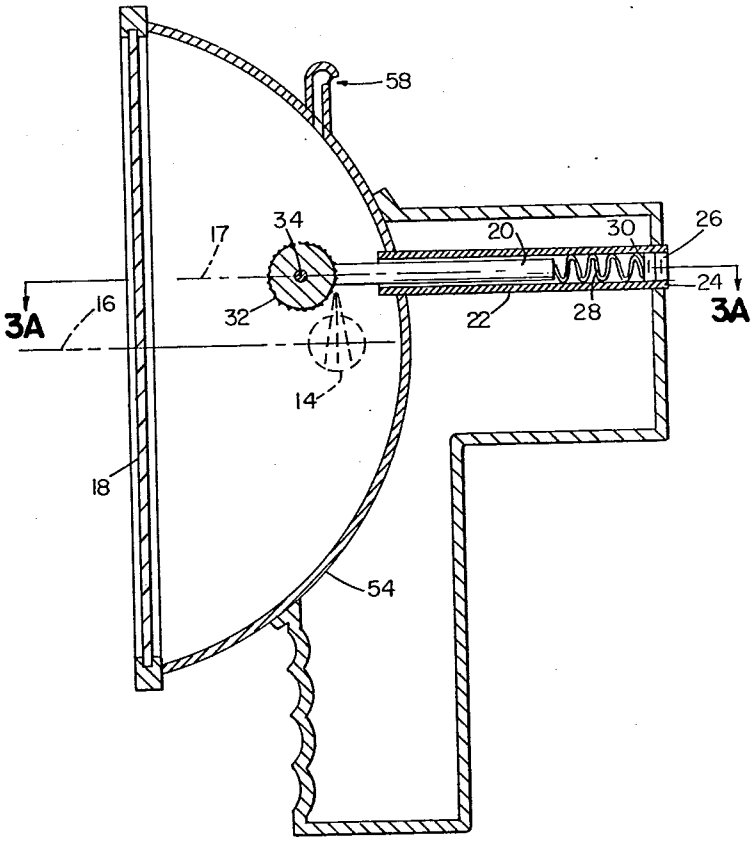
FIGS. 3 and 3A are sectional views of a manually driven emergency lamp.
Figure 3A:
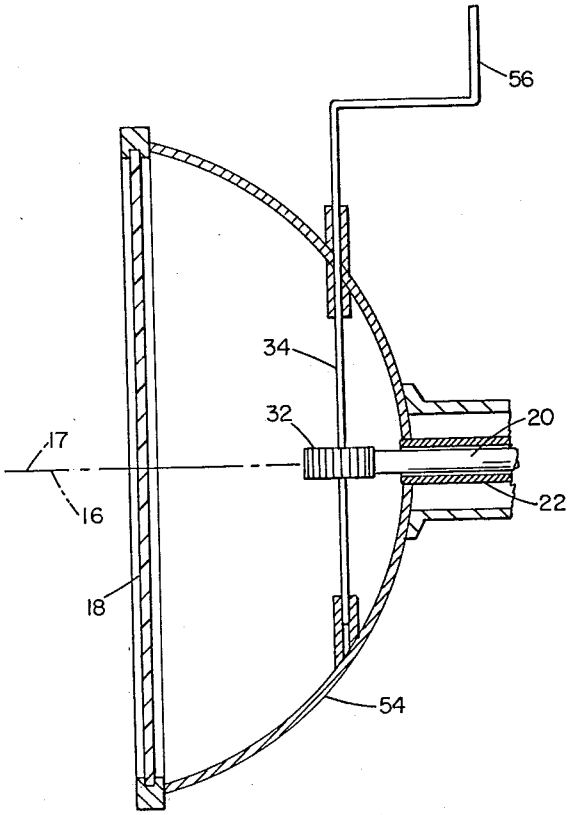

In the manually driven emergency lamp shown in FIGS. 3 and 3A, reflector 54 is spherical to provide a broader beam of light than the parabolic reflector of FIG. 1. Wheel 32 and rod 20 are located along an axis vertically above reflection zone 14 and shaft 34 extends horizontally, with manually operated crank 56 located at the end of the shaft. The diameter of the wheel is increased to 1 inch and the radius of the crank is substantially greater than that of the wheel to obtain illumination comparable to that provided by the motor driven unit of FIG. 1 at speeds of rotation obtainable with manual operation, e.g., 3 rps. The space enclosed by the reflector and the window is vented to the atmosphere through water repelling vent 58 to allow the escape of combustion products and the admission of oxygen for combination with the pyrophoric material. The lamp, as an emergency lamp, has a virtually unlimited storage life, so that it is always available in an emergency, and is controllable so that it can be turned on and off as needed, thereby providing a long use life. The reflector allows the light beam to be aimed, which is advantagous in, e.g., signalling aircraft or ships, and protects the operator's eyes from the intense light produced in the reflecting zone, to prevent eye injury and to preserve the operator's visual adaption to low light level conditions. The lamp can also be used to transmit, e.g., Morse code, with one turn of the crank sending a dot and five turns sending a dash. When used as a signalling lamp, the lamp is visible to the unaided eye at extended distances, e.g., five miles and greater in clear conditions. In a less expensive version, e.g. for automobile emergency kits, the window and vent can be omitted, and the reflector can be of inexpensive conical shape.

Figure 4:
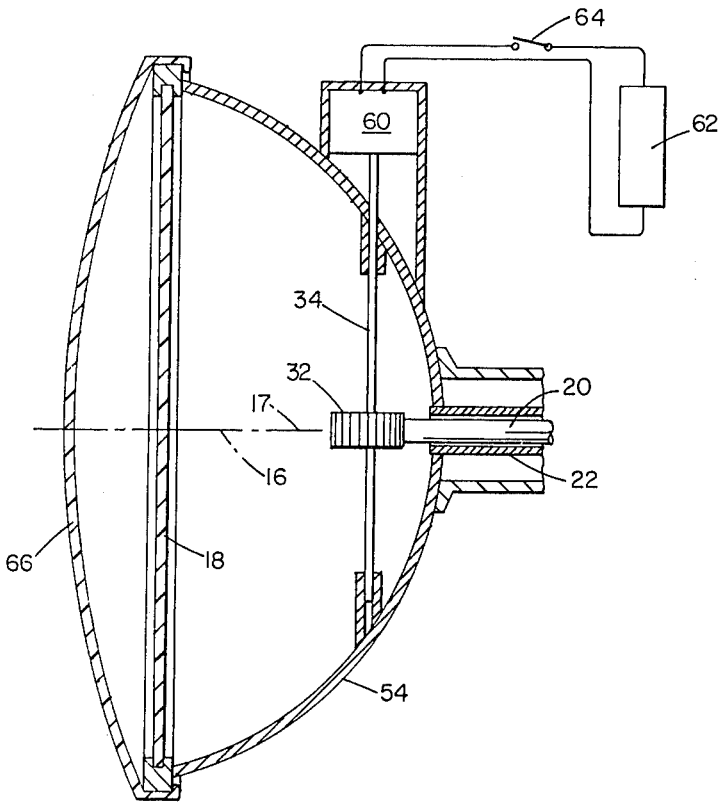
FIG. 4 is a diagrammatic view of a spring driven lamp having a reflector and a detachable diffusing element.

In an alternate embodiment shown in FIG. 4, wheel 32 is driven by electric motor 60 which is energized by batteries 62 through switch 64. Reflector 54 is again of spherical shape to provide a broader beam of light. Also shown is detachable diffuser 66 which may be used to further diffuse the light from the lamp. The space enclosed by the reflector and window is again vented to the atmosphere through a water repelling vent. This embodiment provides a much greater amount of light from the lamp than is available from a standard flashlight using an incandescent bulb and the same batteries. In effect, the use of the electrical power available from the batteries to drive the wheel and generate ignited particles of pyprophoric material amplifies, in terms of the amount of emitted light, the amount of power available from the batteries and is a more efficient use of power than is provided by a standard flashlight.

Other embodiments of the invention are possible and are within the scope of the following claims. E.g., the reflector can be a uniform surface of revolution other than parabolic or spherical, such as elliptical, depending upon the desired shape of the emitted light beam. In certain applications, the reflector can be a flat plate, providing a 180° beam while shielding the operator's eyes. Additionally, wheel 32 may be powered by a hand wound spring motor, the hand driven lamp can include an inertia flywheel on shaft 34, or air motor 36 can be driven by compressed $CO_2$ or nitrogen while the space enclosed by the reflector and window is vented to the atmosphere rather than receiving the exhaust gases from the motor.

The pyrophoric member may advantageously comprise a pyrophoric alloy of cerium and thorium plus other lanthanides for convenience and economy plus a strengthening metal such as aluminium or iron, this alloy's composition being less than 10 percent cerium, preferably 1 to 2 percent so as to give maximum brilliance upon abrading.

What is claimed is:

1. A flashlight comprising a reflector having a reflection zone and constructed to beam light from said zone to a region to be illuminated and an abrasive member and pyrophoric member, said abrasive member and pyrophoric member mounted for predetermined relative movement against each other to produce and project a stream of self-igniting particles of pyrophoric material abraded from said pyrophoric member, the direction of said relative projecting movement aligned with said reflection zone of said reflector, and the point of contact between said abrasive member and pyrophoric member positioned to present said stream of particles while burning to said reflection zone and means for producing said relative movement between said abrasive member and pyrophoric member.

2. The apparatus of claim 1 wherein said reflector comprises a uniform surface of revolution adapted to provide a concentrated beam of light and to shield the operator's eyes from said burning particles.

3. The apparatus of claim 2 wherein said reflector is of parabolic shape.

4. The apparatus of claim 2 wherein said reflector is a spherical shape.

5. The apparatus of claim 1 wherein said pyrophoric member is a substantially stationary rod and said abrasive member is a rotating wheel, said rod being adapted to be fed along its axis toward said abrasive wheel as it is consumed.

6. An emergency signalling light apparatus comprising as operative components:

an abrasive rotatable wheel and means to rotate said wheel, a substantially stationary rod of pyrophoric material, and means for biasing said rod into engagement with said wheel for producing and projecting a stream of self-igniting particles of pyrophoric material abraded from said rod, said biasing means adapted to feed said rod along its axis toward said abrasive wheel as it is consumed, the direction of rotation of said wheel and the axis of said rod being oriented to present said stream of particles to a light-transmitting combustion zone, the size and relationship of said operative components characterized by the capability of providing a high intensity light visible for extended distances for a signalling interval.

7. The apparatus of claim 5 or 6 wherein said rod is adapted to engage the rim of said abrasive wheel.

8. The apparatus of claims 5 or 6 further comprising spring means for resiliently biasing said rod along its said axis in engagement with said wheel.

9. The apparatus of claims 1, 2, 5, or 6 including a transparent cover over said reflector for transmitting light from said zone while protecting the same and said abrasive and pyrophoric members.

10. The apparatus of claims 5 or 6 further including hand powered means for driving said wheel.

11. The apparatus of claim 10 wherein said hand powered means includes a crank having a handle at a radius substantially greater than that of said wheel.

12. The apparatus of claims 5 or 6 including a gas driven motor arranged to drive said wheel.

13. The apparatus of claim 2 wherein the exhaust of said motor is arranged to exhaust combustion products produced by said wheel and said pyrophoric member, thereby to keep said reflector clean.

14. The apparatus of claims 5 or 6 including a watertight housing surrounding said elements.

15. The apparatus of claims 5 or 6 including an electric motor for driving said wheel and means for associating therewith storage batteries for driving said motor.

16. The apparatus of claims 1, 5 or 6 wherein said pyrophoric member is lanthanide-series misch steel.

17. The apparatus of claims 1, 5 or 6 wherein said pyrophoric member is cerium-iron.

18. The apparatus of claims 1, 5 or 6 wherein said wheel is of the order of 1 inch in diameter and is arranged to be driven by hand.

* * * * *